United States Patent [19]

Nishizako et al.

[11] Patent Number: 4,661,883

[45] Date of Patent: Apr. 28, 1987

[54] ELECTROMAGNET APPARATUS WITH SHORTENED ARMATURE RELEASE TIME

[75] Inventors: Shizutaka Nishizako; Toshikazu Kitou; Shinki Shoji; Sadaaki Baba, all of Nagoya, Japan

[73] Assignee: Mitsubishi Denki Kabushiki Kaisha, Tokyo, Japan

[21] Appl. No.: 832,959

[22] Filed: Feb. 26, 1986

[30] Foreign Application Priority Data

Mar. 8, 1985 [JP] Japan ..... 60-44893
Mar. 8, 1985 [JP] Japan ..... 60-44894
Mar. 8, 1985 [JP] Japan ..... 60-44895

[51] Int. Cl.[4] ..... H01H 47/32
[52] U.S. Cl. ..... 361/159
[58] Field of Search ..... 361/159; 318/452

[56] References Cited

U.S. PATENT DOCUMENTS 4,032,823 6/1977 Arvisenet ..... 361/194
4,274,122 6/1981 Hansen et al. ..... 361/159

FOREIGN PATENT DOCUMENTS 59-59448 4/1984 Japan .

*Primary Examiner*—L. T. Hix
*Assistant Examiner*—David Porterfield
*Attorney, Agent, or Firm*—Sughrue, Mion, Zinn, Macpeak and Seas

[57] ABSTRACT

An electromagnet coil 2 wound on a fixed iron core 6 is energized by d.c. current supplied from a full-wave rectifier 1 to attract a movable armature 7. A transistor 10 is connected in series with the coil, a bias resistor 8 is connected across the coil to the base of the transistor, and a capacitor is connected between the base and collector of the transistor. The capacitor absorbs inductive energy stored in the coil 2 when the a.c. supply circuit is opened to thereby reduce the armature release time.

6 Claims, 20 Drawing Figures

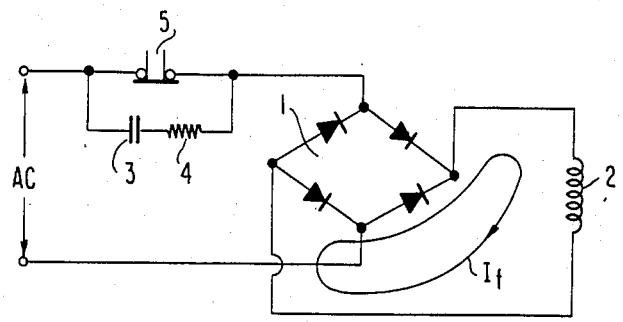
FIG. 1
PRIOR ART
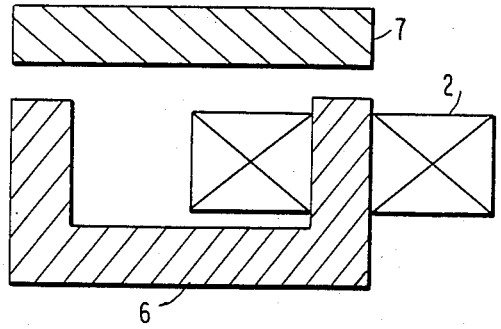
FIG. 2
PRIOR ART
FIG. 3
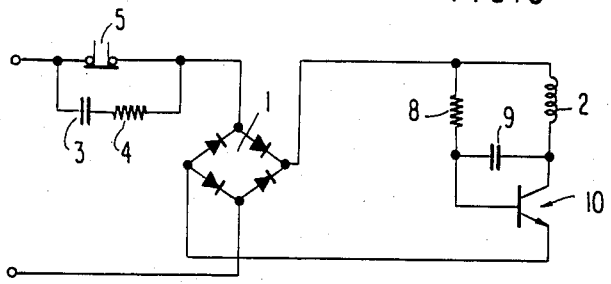
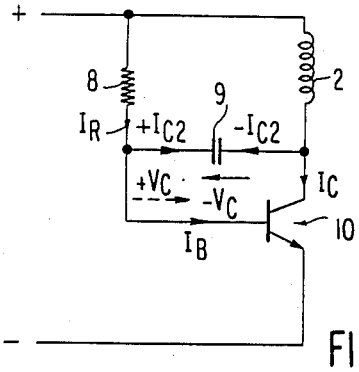
FIG. 5
FIG. 6
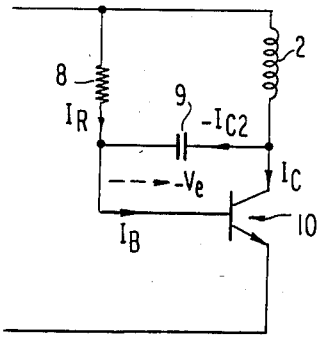
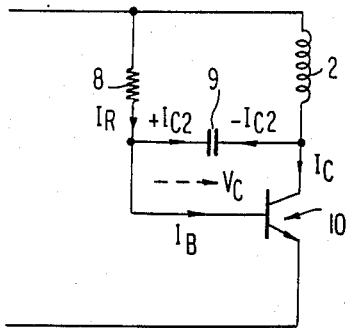
FIG. 7

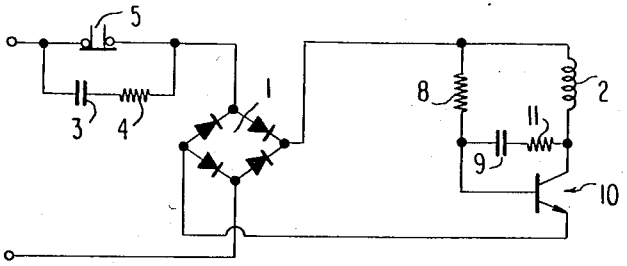
FIG. 8
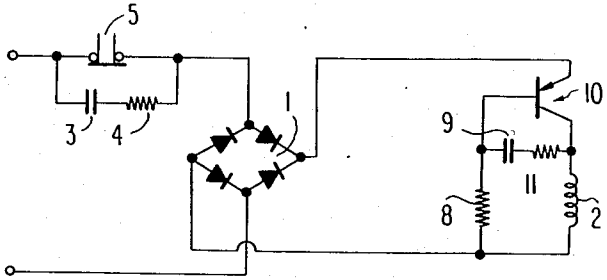
FIG. 9
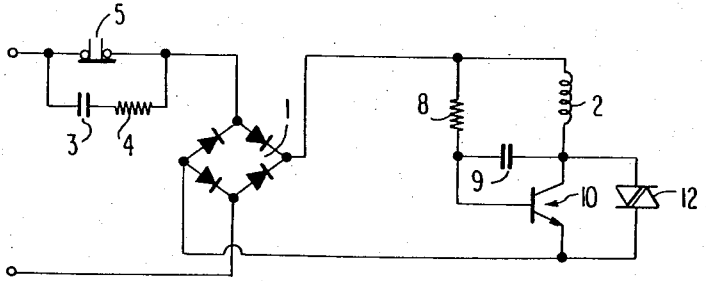
FIG. 10
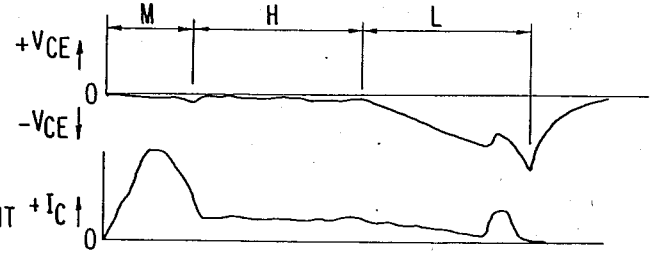
FIG. 4 (a) COLLECTOR EMITTER VOLTAGE
FIG. 4 (b) COLLECTOR CURRENT
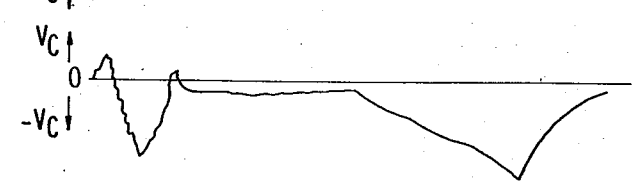
FIG. 4 (c) CAPACITOR VOLTAGE
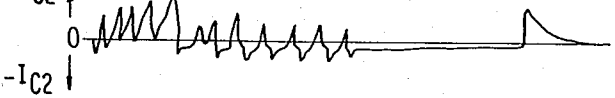
FIG. 4 (d) CAPACITOR CURRENT
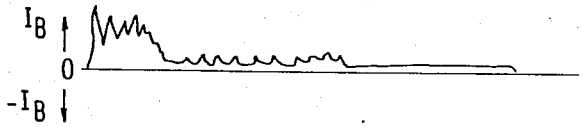
FIG. 4 (e) BASE CURRENT
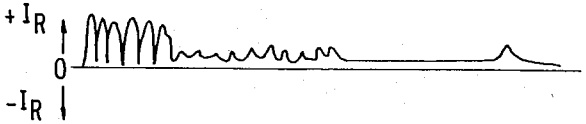
FIG. 4 (f) RESISTOR CURRENT

ELECTROMAGNET APPARATUS WITH SHORTENED ARMATURE RELEASE TIME

BACKGROUND OF THE INVENTION

1. Field of the Invention

This invention relates to an electromagnet apparatus used, for example, for making and breaking a contact for an electromagnetic switch, and more particularly to a power supply circuit for such an electromagnet apparatus.

2. Description of the Prior Art

FIGS. 1 and 2 show a prior art electromagnet apparatus as disclosed in Japanese Utility Model Laid-Open No. 84-59448, wherein a full-wave rectifier 1 converts a.c. current into d.c. current supplied to a coil 2. A holding current capacitor 3 in series with a resistor 4 is connected in parallel across a closure switch 5. The resistor 4 suppresses the large transient discharge current which would otherwise flow through the switch 5 upon its initial closure due to the residual charge build up on the capacitor 3.

The coil 2 is wound around a fixed iron core 6 associated with a movable iron armature 7, which is magnetically attracted to the fixed core when the coil is energized. The switch 5 is closed when it is desired to attract the movable armature 7 to the fixed core 6 from a released state shown in FIG. 2; it is opened shortly before the armature reaches the fixed core, whereafter a reduced amplitude current flows through the capacitor 3 and resistor 4 to continue the attractive movement of the armature until it engages the fixed core 6 and then holds the armature in such engagement.

The movable armature 7 is thus attracted by a large magnetic force when the gap is large, and held by a smaller magnetic force after being attracted. The holding power consumed by the coil is therefore reduced, and since only d.c. current flows through the coil no electromagnetic noise or chatter occurs.

With such an arrangement, if the applied a.c. voltage is interrupted to release the armature, a flywheel current flow arises due to inductive energy stored in the coil 2 as shown by the arrow If in FIG. 1. Such current is progressively damped by the L-R circuit of the coil, and the movable armature 7 is released when the attractive force of the electromagnet becomes lower than the repulsive force of a tripping spring (not shown) This flywheel effect extends the release period of the movable armature, and the delay time increases in proportion to the inductance value of the electromagnet coil 2. Such release delay renders the prior art circuit unsuitable for making and breaking switch contacts in situations in which precise timing control is essential.

SUMMARY OF THE INVENTION

The present invention solves the above problem by providing an electromagnet apparatus having a decreased armature release period. This is achieved by connecting the emitter-collector path of a transistor in series with the coil for the fixed iron core, connecting a biasing resistor between the transistor base and an opposite side of the coil, and coupling a capacitor across the base-collector terminals. The capacitor quickly absorbs the inductive energy stored in the coil when the external supply voltage is interrupted to thereby more rapidly damp the flywheel current and shorten the armature release time.

BRIEF DESCRIPTION OF THE DRAWINGS

FIG. 1 is a circuit diagram showing a prior art electromagnet apparatus;

FIG. 2 is a sectional view of the core and armature of the prior art electromagnet apparatus;

FIG. 3 is a circuit diagram showing a preferred embodiment of the present invention;

FIGS. 4(*a*) through 4(*f*) are waveform diagrams for the circuit of FIG. 3;

FIGS. 5 to 7 are circuit diagrams for explaining the operation of the circuit of FIG. 3; and FIGS. 8 through 15 are circuit diagrams showing alternate embodiments of the invention.

DETAILED DESCRIPTION OF THE PREFERRED EMBODIMENTS

Figure 11:
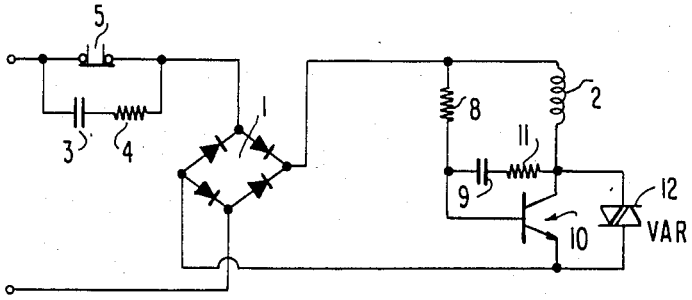

Referring first to FIG. 3, in which reference numerals 1 to 5 designate the same components as in FIG. 1, an NPN transistor 10 has its emitter-collector path connected in series with the coil 2, and its base is biased by a resistor 8 having one end connected to the positive terminal of the coil. A capacitor 9 having one end connected to the negative terminal of the coil stabilizes the bias for the transistor 10 and absorbs the inductive energy stored in the coil when the transistor is switched OFF.

When an a.c. voltage is applied to the input terminals, a bias voltage is impressed via the switch 5 and the rectifier 1 on the base of the transistor 10 by the resistor 8.

FIG. 4(*a*) shows the collector-emitter voltage of the transistor 10, FIG. 4(*b*) shows the collector current, FIG. 4(*c*) shows the voltage of the capacitor 9, FIG. 4(*d*) shows the current in the capacitor, FIG. 4(*e*) shows the base current of the transistor, and FIG. 4(*f*) shows the current flowing through the bias resistor 8. The movable armature 7 is attracted to the fixed core 6 during time span M, it is held against the core during time H, and it is released during time L.

When a bias voltage is applied as described above, a base current $I_B$ flows as shown in FIGS. 4(*e*) and 5, and current starts to flow from the coil 2 through the collector and emitter of the transistor. The fixed core 6 is thus energized and the armature 7 begins to move toward the core. Before the armature reaches the core the switch 5 is opened to reduce the current to that flowing through the capacitor 3, which is sufficient to complete the closing movement of the armature and to thereafter hold it against the core 6. In this holding state the base of transistor 10 is supplied, as shown by FIGS. 4(*d*), (*e*) and (*f*) and in FIG. 6, with current $I_R$ from the bias resistor 8 and current $I_{C2}$ from the capacitor 9, and thus a stabilized current flows to provide the necessary bias.

If the external supply voltage is then removed, the capacitor 9 is charged by the inductive energy stored in the coil 2 as shown in FIGS. 4(*c*) and 7. At the same time a flywheel circuit is formed between the rectifier 1 and the coil 2 via the collector-emitter path of the transistor 10, whereupon a current damping phenomenon occurs in the L-C-R circuit and the movable armature 7 is released when the attractive force of the core 6 is exceeded by the force of a tension spring (not shown).

With this arrangement the release period of the movable armature at the time the external voltage supply is cut off is shortened by allowing the inductive energy stored in the coil 2 to be absorbed and dissipated by the capacitor 9, i.e. by providing a more rapid and effective flywheel current damping. It is thus possible to provide an electromagnet apparatus which is applicable to a switch or the like in which precise positional and timing control is required. Further, if the capacitor 9 deteriorates with time and use and becomes lower in its storage capacity, the release period of the armature will be further shortened as the capacitor will charge more quickly.

As alternatives, a resistor 11 can be connected in series with the capacitor 9 as shown in FIG. 8, and a PNP transistor 10 can be used as shown in FIG. 9 but connected to the positive side of the coil to attain the same functions and effects as in the above described embodiment.

Although the armature release time becomes shorter the smaller the value of the capacitor 9, the capacitor charging voltage and the collector-emitter voltage conversely increase; the capacitance value must thus be set at a reasonable level. However, since such an electromagnet apparatus is expected to function for several million switching operations, a varistor 12 may be connected across the transistor as shown in FIG. 10 to suppress these voltage increases and cut off their peak values as the capacitor ages.

Figure 12:
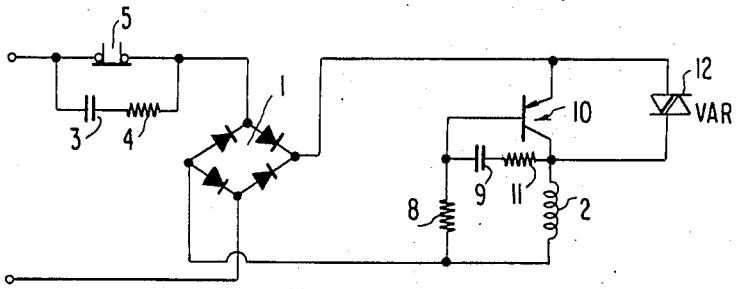
Figure 13:
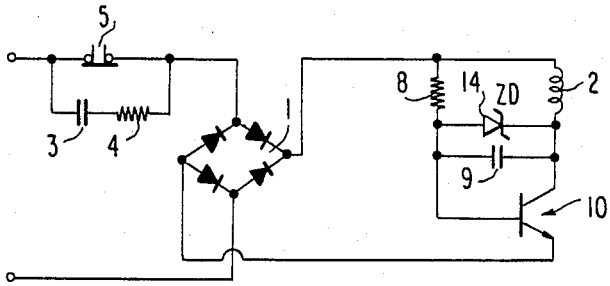
Figure 14:
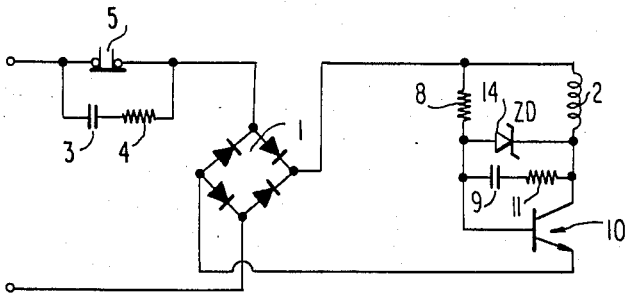
Figure 15:
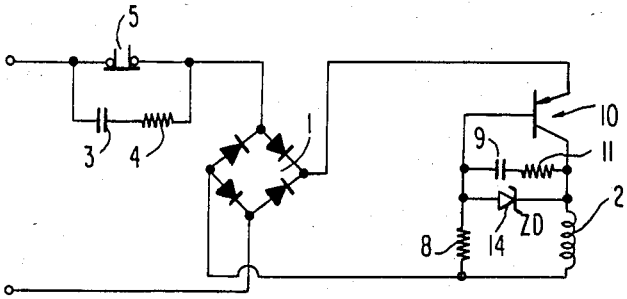

As further alternatives a resistor 11 may be connected in series with the capacitor 9 as shown in FIG. 11, which otherwise corresponds to FIG. 10, a varistor 12 may be added to the embodiment of FIG. 9 as shown in FIG. 12, a Zener diode 14 connected across the collector and base of the transistor may be used instead of a varistor to cut off peak voltage surges as the capacitor ages as shown in FIG. 13, a resistor 11 may be added to such Zener diode embodiment as shown in FIG. 14, and the varistor of FIG. 12 may be replaced with a Zener diode as shown in FIG. 15. All of these various alternatlves shorten the armature release time in the same manner as described in connection with FIGS. 3–7.

What is claimed is:

1. An electromagnet apparatus including a full-wave rectifier (1), a.c. signal supply means coupled across input terminals of the rectifier, a fixed magnetic core (6), a movable magnetic armature (7) operably disposed proximate the core, and a coil (2) connected across output terminals of the rectifier and wound on the core for attracting the armature thereto when energized, characterized by: means for absorbing inductive energy stored in the coil upon an interruption of the supply means to reduce a release time of the armature from the core, said energy absorbing means comprising:

(a) a transistor (10) having an emitter-collector path connected in series with one side of the coil, (b) a bias resistor (8) connected between another, opposite side of the coil and a base of the transistor, and (c) a capacitor (9) connected between the base and collector of the transistor.

2. An electromagnet apparatus according to claim 1, further comprising a resistor (11) connected in series with said capacitor.

3. An electromagnet apparatus according to claim 1, further comprising a surge absorbing element (12) connected between the emitter and collector of said transistor.

4. An electromagnet apparatus according to claim 3, further comprising a resistor (11) connected in series with said capacitor.

5. An electromagnet apparatus according to claim 1, further comprising a surge absorbing element (14) connected between the base and collector of said transistor.

6. An electromagnet apparatus according to claim 5, further comprising a resistor (11) connected in series with said capacitor.

* * * * *